US006049176A

United States Patent [19]

Aoki et al.

[11] Patent Number: 6,049,176

[45] Date of Patent: Apr. 11, 2000

[54] IGNITION DEVICE FOR AN INTERNAL COMBUSTION ENGINE

[75] Inventors: Keiichiro Aoki, Susono; Yoichi Kurebayashi, Toyohashi, both of Japan

[73] Assignees: Toyota Jidosha Kabushiki Kaisha, Aichi-ken; Denso Corporation, Aichi-Pref., both of Japan

[21] Appl. No.: 08/918,384

[22] Filed: Aug. 26, 1997

[30] Foreign Application Priority Data

Sep. 3, 1996 [JP] Japan ..... 8-232885

[51] Int. Cl.[7] ..... F02P 17/00

[52] U.S. Cl. ..... 315/209 M; 315/209 T; 315/209 CD; 315/209 SC; 315/211

[58] Field of Search ..... 315/209 M, 209 T, 315/209 CD, 209 SC, 211

[56] References Cited

U.S. PATENT DOCUMENTS

| | | | |
|---|---|---|---|
| 3,945,362 | 3/1976 | Neuman et al. | 315/209 T |
| 4,119,868 | 10/1978 | Schach et al. | 315/209 T |
| 4,201,926 | 5/1980 | Caron | 315/209 T |
| 4,329,950 | 5/1982 | Orova et al. | 315/209 T |

FOREIGN PATENT DOCUMENTS

| | | |
|---|---|---|
| 0 48 92 64 | 6/1992 | European Pat. Off. . |
| 1952 45 41 | 12/1996 | Germany . |
| 6299941 | 10/1994 | Japan . |

OTHER PUBLICATIONS

Patent Abstracts of Japan, vol. 095, no. 001, Feb. 28, 1995 (1995 02 28) & JP 06 299941 A (Nippondenso Co., Ltd.) Oct. 25, 1994 (1994–10–25).

Patent Abstracts of Japan, vol. 018, no. 491 (M–1672), Sep. 13, 1994 (1994–09–13) & JP 06 159129 A (Daihatsu Motor Co., Ltd.: Others: 01), Jun. 7, 1994.

*Primary Examiner*—Don Wong
*Assistant Examiner*—Hoang Nguyen
*Attorney, Agent, or Firm*—Kenyon & Kenyon

[57] ABSTRACT

An ignition device for an internal combustion engine capable of suppressing not only a decrease in the discharge energy of the spark plug but also the LC resonance itself. When an igniter 13 is turned on by an ignition timing control unit 14 and a current flows into a primary coil 111 of the igniter 11, a FET 31 is turned off by the ignition timing control unit 14, whereby the primary coil is cut off from an LC resonance-absorbing resistor 32 to prevent a decrease in the current flowing into the primary coil. The ignition timing control unit 14 turns the igniter 13 off and turns the FET 31 on a predetermined period after the start of discharge of the secondary coil 112, whereby the primary coil and the LC resonance-absorbing resistor are connected together to absorb LC resonance after the discharge of the secondary coil, in order to suppress the occurrence of noise caused by LC resonance.

12 Claims, 5 Drawing Sheets

IGNITION DEVICE FOR AN INTERNAL COMBUSTION ENGINE

BACKGROUND OF THE INVENTION

1. Field of the Invention

The present invention relates to an ignition device for an internal combustion engine and, particularly, to an ignition device for an internal combustion engine capable of preventing the reduction of discharge energy of a spark plug and of suppressing noise caused by LC resonance after the completion of discharge of the ignition coil.

2. Prior Art

In an internal combustion engine using gasoline as a fuel, the gas mixture compressed by a piston is ignited by an electric discharge of a spark plug. In an ignition device that is generally used, a high voltage of 20 to 30 KV induced in the secondary coil when a current flowing into the primary coil of the ignition coil is interrupted is supplied to the spark plug.

In fact, however, energy accumulated in the primary coil or in the secondary coil is not completely consumed by the electric discharge of the spark plug, and surplus energy causes LC resonance, after the ignition, due to parasitic inductance and parasitic capacitance of a high-tension cable that connects a distributor to the spark plug. The LC resonance affects various devices as noise.

FIG. 1 is a diagram schematically illustrating an ignition circuit for an internal combustion engine, wherein an end of a primary coil 111 of an ignition coil 11 is connected to the positive electrode of a battery 12, and the other end is grounded through collector and emitter of a switching transistor 13 included in an igniter.

The base of the transistor 13 is connected to an ignition timing control unit 14. The transistor 13 is turned on when an ignition signal IGT is output from the ignition timing control unit 14.

One end of a secondary coil 112 of the ignition coil 11 is also connected to the positive electrode of the battery 12, but its other end is connected to the spark plug 18 through a reverse current-preventing diode 15, a distributor 16 and a high-tension cable 17.

When the ignition signal IGT from the ignition timing control unit 14 is turned on, a pulse generated in the secondary coil 112 is blocked by the reverse current-preventing diode 15. When the ignition signal IGT is tuned off, however, a pulse generated in the secondary coil 112 passes through the reverse current-preventing diode 15 so that an electric discharge takes place on the spark plug 18.

A device that will be affected by the noise due to LC resonance may be an ionic current detector for detecting a current that flows through ions generated by the combustion of a mixture gas.

The ionic current detector 19 is connected in parallel with the spark plug 18 at the output side of the distributor 16.

An ionic current is guided, through a protection diode 191, to a series circuit consisting of a current-voltage converting resistance 192 and a bias power source 193. A voltage generated at a point where the current-voltage converting resistance 192 and the protection diode 191 are connected together is guided, through a DC component-cutting capacitor 194, to an amplifying circuit 195 composed of an operational amplifier and resistors.

Therefore, a voltage signal proportional to the AC component of the ionic current is outputted at the output terminal 196 of the ionic current detector 19.

However, the ionic current is so weak that the amplifying circuit must have a large gain and a large input impedance, and the amplifying circuit may be easily affected by the external noise. In order to solve this problem, "an ionic current detector" in which the output of an ion detector 19 is masked while LC resonance is taking place has been already proposed (see Japanese Unexamined Patent Publication No. 6-299941).

When the engine speed increases, however, LC resonance period becomes so close to the period for observing ionic current for detecting knocking or misfiring that it becomes difficult to control the timing for opening and closing the mask.

In other words, though the LC resonance period is not affected by the engine speed, the period for observing the ionic current approaches the LC resonance period in accordance with an increase in the engine speed.

Besides, if the LC resonance is masked, the LC resonance is not substantially removed, and the devices other than the ionic current detector are not free from being affected by noise caused by LC resonance.

It is advantageous to control the LC resonance itself after the electric discharge of the secondary coil of the ignition coil. For this purpose, it can be contrived to provide a so-called snubber for absorbing LC resonance in parallel with the primary coil or the secondary coil of the ignition coil.

FIG. 2 is a diagram to explain ways to provide the snubber. There can be contrived two ways, the first way provides the first snubber 21 constituted by a diode and a resistor connected in series (or a resistor and a capacitor connected in series) in the primary coil 111, and the second way provides the second snubber 22 which is a resistor in the secondary coil 112.

The first snubber 21 must have a diode for improving the efficiency for transferring energy accumulated in the primary coil 111 to the secondary coil 112. When the voltage across the diode becomes lower than the forward voltage drop of the diode (about 0.6 V), however, the effect of snubber for absorbing the LC resonance is no longer exhibited.

The second snubber 22 consumes part of the energy, inevitably causing a decrease of the ignition energy. Besides, the voltage across the second snubber reaches 20 to 30 KV and, hence, the device itself must have a high breakdown voltage.

The present invention is accomplished in view of the above-mentioned problems, and provides an ignition device for an internal combustion engine capable of suppressing noise due to LC resonance after the discharge of the ignition coil without decreasing discharge energy of the spark plug.

SUMMARY OF THE INVENTION

An ignition device for internal combustion engines according to the first invention comprises:

- an ignition coil comprised of a primary coil to which an ignition command signal is applied and a secondary coil which generates an induced voltage based upon the ignition command;
- a series connection of a current attenuating means for attenuating the current that flows through said primary coil and a switching means for connecting or disconnecting said current attenuating means and said primary coil, said series connection being connected in parallel with said primary coil; and a control means for disconnecting said switching means while the current is being supplied to said primary coil and for connecting said switching means while said secondary coil is being discharged.

In this ignition device, the current attenuating means is disconnected from the primary coil while the current is being supplied to the primary coil in order to suppress the reduction in the current that flows into the primary coil, and the current attenuating means is connected to the primary coil while the secondary coil is being discharged, thereby to suppress LC resonance.

An ignition device for internal combustion engines according to the second invention further comprises an ionic current detection means for detecting an ionic current that flows across a pair of electrodes installed in a combustion chamber of the internal combustion engine through ions generated when the gas mixture has burned in the combustion chamber, wherein said control means connects said switching means while said secondary coil is being discharged, and disconnects said switching means after the end of combustion of the gas mixture in the combustion chamber.

According to the ignition device, the current attenuating means is connected to the primary coil while the ionic current detection means connected in parallel with the spark plug is detecting the ionic current, in order to suppress LC resonance as well as to prevent even a small noise from being superposed on the ionic current.

DETAILED DESCRIPTION OF THE PREFERRED EMBODIMENTS

Figure 1:
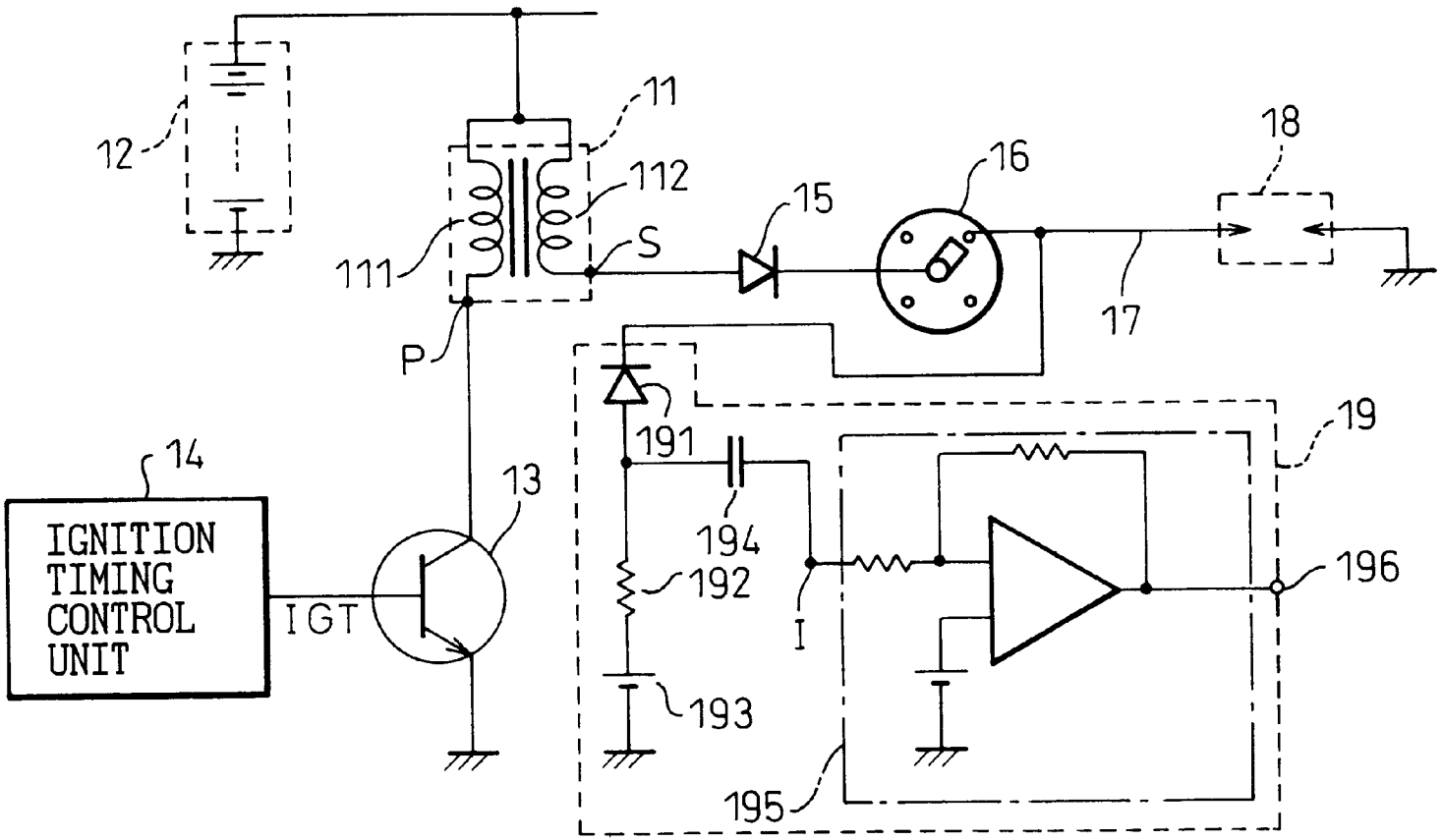
FIG. 1 is diagram schematically illustrating an ignition circuit for an internal combustion engine.
Figure 2:
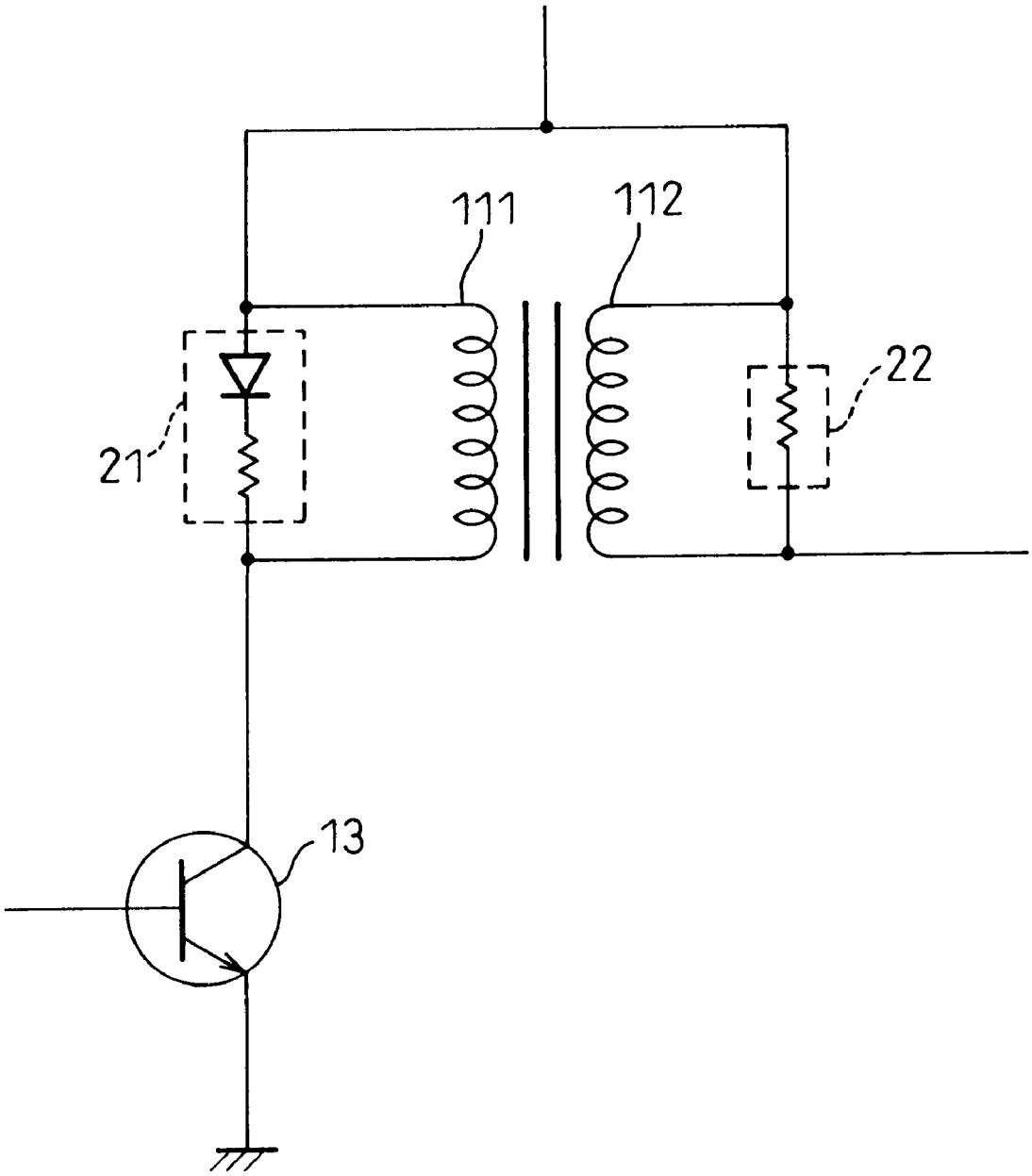
FIG. 2 is a diagram to explain ways how to provide a snubber.
Figure 3:
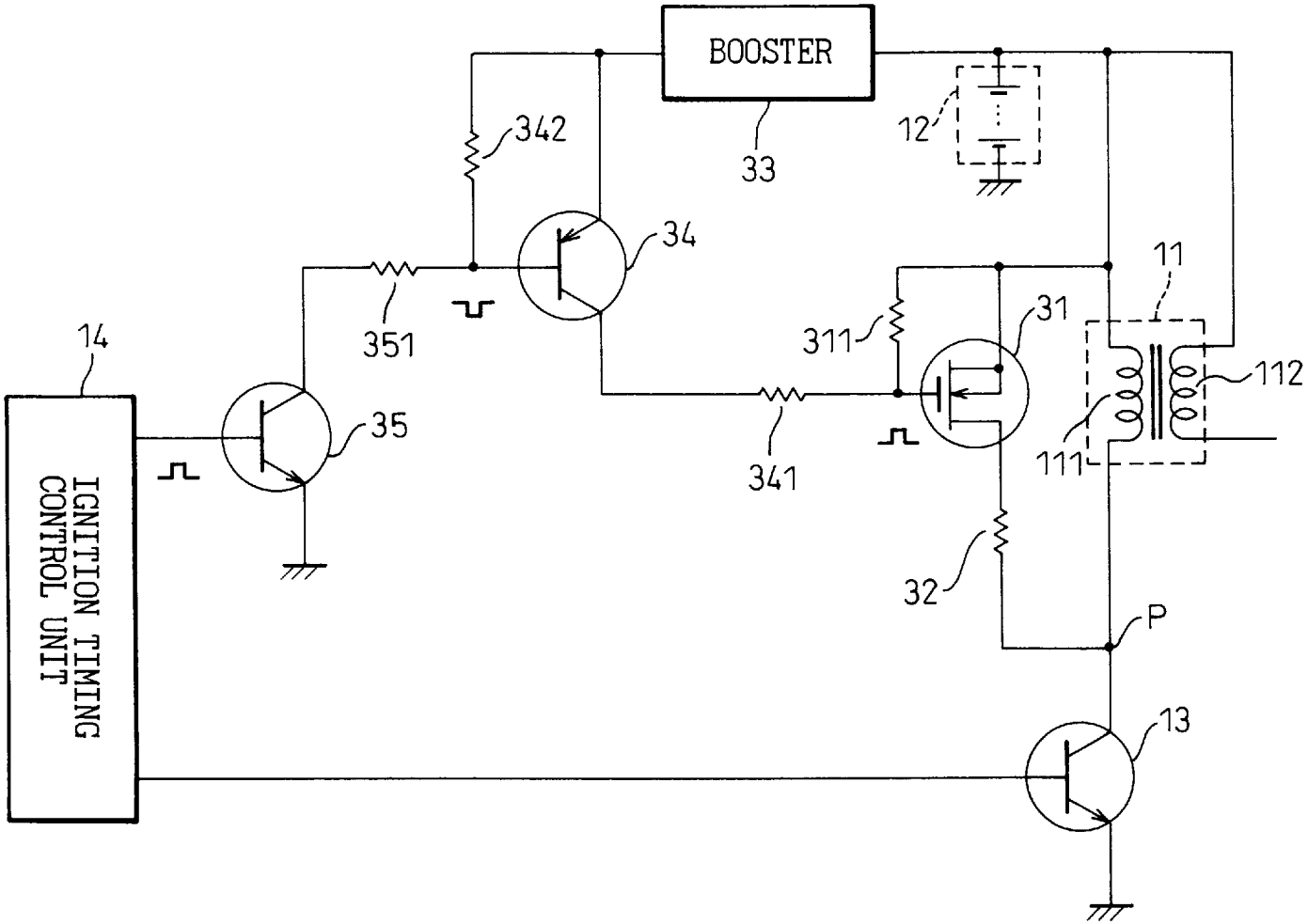
FIG. 3 is a diagram illustrating the constitution of an ignition device for an internal combustion engine according to an embodiment of the present invention.
Figures 4A, 4B, 4C, 4D:
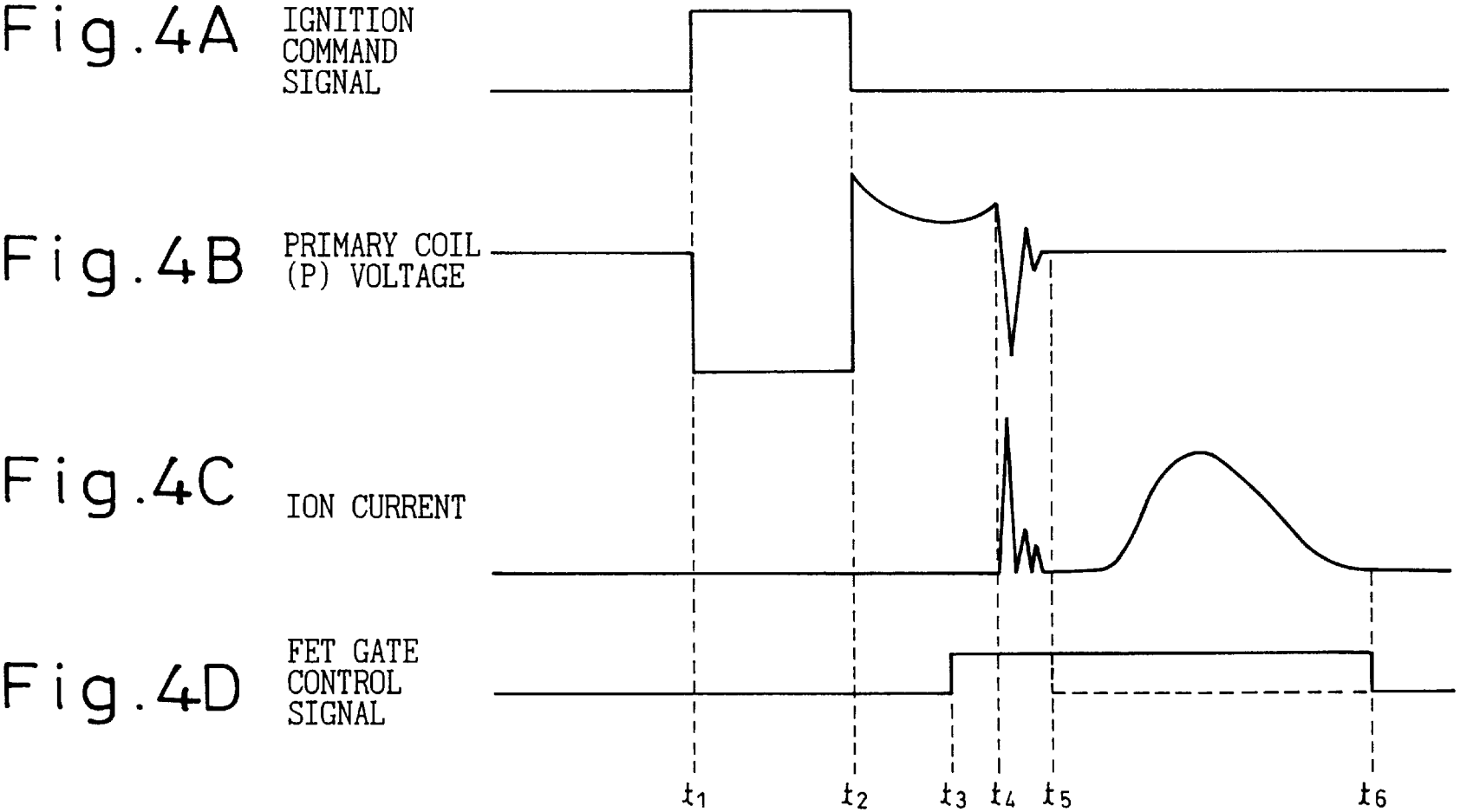
FIGS. 4A to 4D are diagrams illustrating a method of determining timings for opening and closing a FET gate.

FIG. 3 is a diagram illustrating the constitution of an ignition device for an internal combustion engine according to an embodiment of the present invention, wherein the same elements as those of FIG. 1 are denoted by the same reference numerals.

One end of the primary coil 111 of the ignition coil 11 is connected to the battery 12 and the other end is grounded through the collector and the emitter of a transistor 13 which is an igniter.

A series connection of a field-effect transistor (FET) 31 and an LC resonance-absorbing resistor 32, is connected in parallel with the primary coil 111. The FET 31 controls the connection of the LC resonance-absorbing resistor 32 to the primary coil, and the LC resonance-absorbing resistor 32 absorbs LC resonance after the discharge of the secondary coil 112.

The gate of the FET 31 is connected to the collector of the second gate control transistor 34. The emitter of the second gate control transistor 34 is connected to the battery 12 through a booster 33 which is a DC—DC converter and applies a potential difference of about 5 V between the source and the gate to drive the FET 31.

The base of the second gate control transistor 34 is connected to the collector of the first gate control transistor 35, the emitter thereof is grounded, and a control signal is applied to its base from the ignition timing control unit.

There are further arranged a FET bias resistor 311 for biasing the gate of FET 31, a second collector resistor 341 for limiting the collector current when the second gate control transistor 34 is turned on, a second bias resistor 342 for biasing the base of the second gate control transistor 34, and a first collector resistor 351 for limiting the collector current of when the first gate control transistor 35 is turned on.

When the ignition timing control unit 14 outputs an FET gate open command signal of the "H" level, the first gate control transistor 35 is turned on, and the base potential of the second gate control transistor 34 changes from the "H" level to the "L" level. Then, the second gate control transistor 34 is turned on, the gate of the FET 31 is inverted from the "L" level to the "H" level, and the FET 31 is turned on. When the FET 31 is turned on, the LC resonance-absorbing resistor 32 is connected in parallel with the primary coil of the ignition coil 11.

FIGS. 4A to 4D are diagrams illustrating a method of determining timings for opening and closing the FET gate, and show an ignition command signal IGT, a primary coil (P-point) voltage, an ionic current, and a FET gate control signal. The abscissa represents the time.

That is, the ignition command signal IGT is turned on at a moment $t_1$, and a voltage changes toward the negative side at the P-point where the primary coil 111 is grounded. When the ignition command IGT is turned off at a moment $t_2$, the voltage at the P-point is suddenly inverted toward the positive side, and the electric discharge of the secondary coil starts.

From a moment $t_4$ where the electric discharge of the secondary coil ends to a subsequent moment $t_5$, the LC resonance occurs due to surplus energy accumulated in the ignition coil 11. An ionic current is generated from the moment $t_5$ to a subsequent moment $t_6$, but the output of the ionic current detector 19 is affected by the LC resonance from the moment $t_4$ to the moment $t_5$.

Therefore, the timings for opening and closing the FET gate can be determined as follows:

1. Timing for closing the FET gate.
   (1) While the ignition signal IGT is being turned on, i.e., during the period of from moment $t_1$ to moment $t_2$, the FET 31 must be turned off to prevent a reduction of the current flowing into the primary coil 111 due to the current through the LC resonance-absorbing resistor 32.
   (2) Immediately after the moment $t_2$ when the ignition command signal IGT is turned off, the mixture gas is ignited by the discharge of the secondary coil 112. In order to prevent a reduction of the discharge energy, the FET 31 must be turned off.
   (3) The LC resonance occurs after the moment $t_4$ at which the discharge of the secondary coil 112 ends. Therefore, the primary coil 111 and the LC resonance-absorbing resistor 32 must be connected together before the moment $t_4$.

From (1) to (3) described above, the FET gate must be closed at a moment $t_3$ between the moment $t_2$ and the moment $t_4$. In practice, the moment $t_3$ is set to be 200 to 300 microseconds after the moment $t_2$.
2. Timing for opening the FET gate.
   Theoretically, the FET gate may be opened at any suitable moment after the moment $t_5$ at which the LC resonance ends. In practice, however, the following matters must be taken into consideration.
   (1) The moment $t_5$ at which the LC resonance ends greatly varies depending upon the operation condition.

(2) Noise may be superposed on the ionic current due to the opening of the FET gate.

(3) A small amount of noise superposed on the ionic current can be decreased by connecting the LC resonance-absorbing resistor 32 to the primary coil from moment $t_5$ to moment $t_6$ when the ionic current flows.

In practice, therefore, the FET gate is opened at the moment $t_6$ when the ionic current becomes "0" (i.e., 8 milliseconds after the FET gate is opened, 90° ATDC or 60° ATDC) or just before the ignition command signal IGT is turned on next time at the same cylinder.

Figure 5:
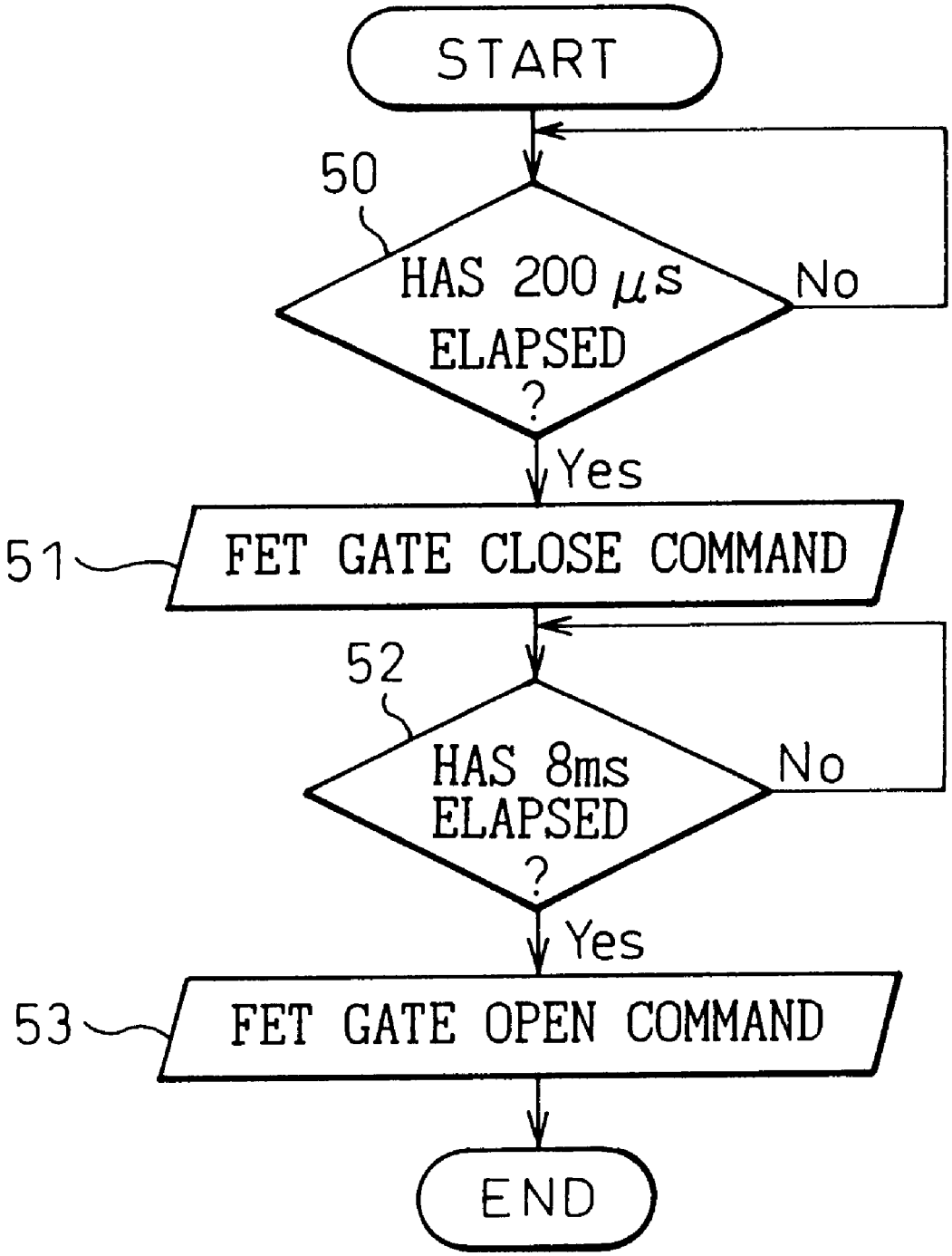
FIG. 5 is a flow chart of a FET gate control routine.

FIG. 5 is a flow chart of a FET gate control routine executed by the ignition timing control unit 14, which is a microcomputer system, and is executed as an interrupt process.

It is determined at step 50 whether 200 microseconds has elapsed after the start of the routine. Step 50 is repetitively executed until 200 microseconds have elapsed.

After 200 microseconds have elapsed, an affirmative determination is rendered by step 50, and a FET gate close command is output at step 51.

At step 52, it is determined whether or not 8 milliseconds has elapsed after the opening of the FET gate. Step 52 is repetitively executed until 8 milliseconds elapses.

After 8 milliseconds have elapsed, an affirmative determination is rendered by step 52, and a FET gate open command is output at step 53 to end the routine.

That is, according to the above-mentioned embodiment, the FET 31 is kept open while the current is flowing into the primary coil 111 of the ignition coil 11 and immediately after the start of discharge of the secondary coil, and the LC resonance-absorbing resistor 32 is cut off from the primary coil 111, preventing a decrease of the current flowing into the primary coil and a decrease in the spark energy of the spark plug 18.

Before the LC resonance takes place, the FET 31 is closed, the LC resonance-absorbing resistor 32 and the primary coil 111 are connected in parallel, and the LC resonance is suppressed by the LC resonance-absorbing resistor 32. By closing the FET 31 for 8 milliseconds, it is made possible to prevent a small amount of noise from being superposed on the ionic current signal detected by the ionic current detector 19.

In the above-mentioned embodiment, the FET gate is closed after 8 milliseconds have elapsed from the opening of the FET gate. However, the FET gate may be closed at 90° ATDC or at 60° ATDC.

In the above-mentioned embodiment, the FET 31 is opened and closed under control of software executed by the ignition timing control unit 14. However, the FET 31 may also be opened and closed by hardware using a so-called discrete element.

We claim:

1. An ignition device for an internal combustion engine comprising:

an ignition coil comprised of a primary coil to which an ignition command signal is applied and a secondary coil which generates an induced voltage based upon the ignition command;

a series connection of a current attenuating means for attenuating the current that flows through said primary coil and a switching means for connecting and disconnecting said current attenuating means and said primary coil, said series connection being connected in parallel with said primary coil;

means for detecting an ionic current that flows across a pair of electrodes installed in a combustion chamber of the engine through ions generated during combustion; and a control means for disconnecting said switching means while the current is being supplied to said primary coil and for connecting said switching means while said secondary coil is being discharged.

2. An ignition device for an internal combustion engine according to claim 1, wherein said control means connects said switching means 200 to 300 microseconds after the turn off of the ignition command.

3. An ignition device for an internal combustion engine according to claim 1 wherein said control means connects said switching while said secondary coil is being discharged, and disconnects said switching means after combustion in the combustion chamber is completed.

4. An ignition device for an internal combustion engine according to claim 3, wherein said control means disconnects said switching means nearly 8 milliseconds after the connection of said switching means.

5. An ignition device for an internal combustion engine according to claim 1, wherein said control means disconnects said switching means between 60° and 90° after the top dead center.

6. An ignition device for an internal combustion engine according to claim 1, wherein said control means disconnects said switching means just before a next ignition command signal for the same cylinder is turned on.

7. A method of controlling the ignition of an internal combustion engine which provides an ignition coil comprised of a primary coil to which an ignition command signal is applied and a secondary coil which generates an induced voltage based upon the ignition command, a series connection of a current attenuating means for attenuating a current that flows through said primary coil, switching means for connecting and disconnecting said current attenuating means and said primary coil, said series connection being connected in parallel with said primary coil, and means for detecting an ionic current that flows across a pair of electrodes installed in a combustion chamber of the engine through ions generated during combustion, the method comprising the steps of:

disconnecting the switching means while the current is being supplied to said primary coil; and connecting the switching means while said secondary coil is being discharged.

8. A method of controlling an ignition of an internal combustion engine according to claim 7, wherein said switching means is connected 200 to 300 microseconds after the ignition command is turned off.

9. A method according to claim 7 wherein the switching means is connected while said secondary coil is being discharged, and is disconnected after combustion in the combustion chamber has been completed.

10. A method of controlling an ignition of an internal combustion engine according to claim 9, wherein said switching means controlling step disconnects said switching means nearly 8 milliseconds after the connection of said switching means.

11. A method of controlling an ignition of an internal combustion engine according to claim 9, wherein said switching controlling step disconnects said switching means between 60° and 90° after the top dead center.

12. A method of controlling an ignition of an internal combustion engine according to claim 9, wherein said switching means controlling step disconnects said switching means just before a next ignition command signal for the same cylinder is turned on.

* * * * *